US005660650A

United States Patent [19]

Okita et al.

[11] Patent Number: 5,660,650

[45] Date of Patent: Aug. 26, 1997

[54] METHOD AND APPARATUS FOR CORRECTING THE HARDENING DEFORMATION OF ANNULAR ELEMENTS

[75] Inventors: Shigeru Okita; Shizuo Mitsuhashi; Kazuo Hayakawa; Akihiro Kiuchi, all of Kanagawa, Japan

[73] Assignee: NSK Ltd., Tokyo, Japan

[21] Appl. No.: 575,523

[22] Filed: Dec. 20, 1995

[30] Foreign Application Priority Data

Dec. 20, 1994 [JP] Japan ..... 6-316757
Dec. 18, 1995 [JP] Japan ..... 7-328712

[51] Int. Cl.[6] ..... C21D 8/10

[52] U.S. Cl. ..... 148/589; 266/115

[58] Field of Search ..... 148/589; 266/115

[56] References Cited

FOREIGN PATENT DOCUMENTS 55-13405 3/1980 Japan ..... C21D 1/673
58-31369 7/1983 Japan ..... C21D 9/40
62-37315 2/1987 Japan ..... C21D 1/18
3-44421 2/1991 Japan ..... C21D 9/40
6083872 10/1994 Japan ..... B21H 1/12
WO9419499 9/1994 WIPO .

OTHER PUBLICATIONS

Patent Abstracts Of Japan; vol. 4 No. 69; JP55-34654; *abstract, Mar. 11, 1980.

*Primary Examiner*—Deborah Yee
*Attorney, Agent, or Firm*—Sughrue, Mion, Zinn, Macpeak & Seas

[57] ABSTRACT

In a method and an apparatus for correcting a hardening deformation of an annular element made out of steel, during the cooling stage of hardening, the annular element which still has an austenitic structure is subjected to working on either the outside or inside diameter, with the degree of working being 0.05–1.0% if it is on the outside diameter with the annular element being pressed into a mold, and 0.5–3.0% if the working is on the inside diameter. Thus the deformation that develops in annular steel elements due to heat treatments is effectively corrected to yield completely round, strain-free or deformation-free annular elements.

5 Claims, 10 Drawing Sheets

5
10
11
12
13
14
15
1
17
19
18
30
24
20
22
21

METHOD AND APPARATUS FOR CORRECTING THE HARDENING DEFORMATION OF ANNULAR ELEMENTS

BACKGROUND OF THE INVENTION

The present invention relates to a method and an apparatus for correcting the hardening deformation of annular steel elements such as raceway rings of rolling bearings.

Annular elements made of steels which can potentially undergo martensite transformation deform during heat treatments, which cause substantial effects on the quality and cost of the final product. Deformation can occur for the following reasons.

(1) Raw materials already have deformation before being hardened. For example, preliminary working such as lathe turning or cold forging may introduce working strain, or heat treatments such as carburization may introduce residual strain; such strains that have already been produced and retained in raw materials are liberated upon heating prior to the cooling stage of hardening, so that the deformation is caused.

(2) Deformations may also develop due to the thermal and transformational strains that occur during the cooling stage of hardening. The amount of deformations increases upon non-uniform heating or cooling. Consider, for example, the stage of vapor film formation in oil quenching; if the vapor film breaks in a certain area, its heat-insulating effect is lost and the area starts to cool earlier than other areas where the vapor film lingers, so that the coexistence of the two areas causes non-uniform cooling, which eventually results in a deformation.

(3) During hardening, a transformational stress causes not only deformation but also residual internal strain due to the non-uniformity of thermal stress mentioned in (2). Particularly in the case where the correction of deformation is performed during the martensite transformation, the internal strain increases because the external force involved in the transformation is applied to the annular elements. The strain transforms and expands in a direction which the retained austenite liberates the strain during the cooling stage of hardening after finishing the correction of deformation, subsequently during a cleaning step and a tempering step. In short, the deforming force to the annular elements is increased.

Among the three reasons mentioned above, (2) is generally held to be the primary cause of hardening deformation; however, the deformations described under (1) and (3) are also significant as factors to the dispersions in the amount of deformation.

Conventionally, the hardening deformations of annular elements of the kind contemplated by the present invention, particularly those which occur on account of reasons (1) and (2), are corrected by the shrinkage that occurs during the cooling stage of hardening, and by the expansion due to the martensite transformation. FIG. 1 shows the dimensional change that occurs during the heating and cooling of a carbon steel through the martensite transformation. In the illustrated case, the steel being heated from an ordinary temperature start expanding progressively from size A. When the temperature reaches the transformation point, the steel shrinks from size B to C, where it becomes austenite. If heating continues to temperature a, the steel expands from size C to D. If the steel in the austenite region is hardened and rapidly cooled, then it shrinks. But, if it passes through the Ms point in the process of cooling, the steel is so transformed from the austenite to martensite as to expand. In short, the steel expands again at size G where the expansion due to the transformation exceeds the shrinkage due to the decreasing temperature. As the temperature further decreasing, the expansion due to the transformation makes progress and the dimensions of the steel keep increasing. When it has been cooled to an ordinary temperature, its dimensions are greater by a size difference H–A than before it was first heated. According to the general method of correcting deformation, the roundness of an annular element is corrected with a mold by utilizing the shrinking or expanding effect of the cooling stage of hardening compared to the mold size indicated in FIG. 1. To correct the inside diameter of the annular element, it is cooled to temperature b above the Ms, whereupon the mold starts to constrain the inside diameter of the annular element and the correction of its diameter is effected as it subsequently shrinks to the Ms. After the passage of the Ms, the annular element starts to expand and when it has been cooled to an ordinary temperature, it becomes larger than the mold and falls away by itself from the mold. On the other hand, the mold starts to constrain the outside diameter of the annular element at temperature c after it passed the Ms and started to expand. The constraint of the outside diameter of the annular element continues to reach a lower temperature. The cooled annular element must be removed forcedly from the mold.

Conventional methods of correcting the hardening deformation of annular steel elements are described in Unexamined Japanese Patent Publication Nos. Hei. 3-44421, Sho. 62-37315 and 58-31369, as well as Examined Japanese Utility Model Publication No. Sho. 55-13405.

However, these conventional methods have serious problems when put to practical use. If a mold is inserted into the bore of an annular element such that its inside diameter is kept being corrected from the start of hardening to the completion thereof, then the production efficiency drops remarkably compared to the case of employing the normal continuous hardening process. In addition, if the workpiece expands due to the martensite transformation, it bites into the mold so that the constraining ring would leave dents which are detrimental to the success of subsequent finishing and other working operations.

Correction could be effected right after the start of hardening and as long as the temperature is still substantial but not higher than the Ms. However, in this method, the dispersions in the dimensions of the annular element before hardening (the dimensions attained by lathe turning or the dimensions after carburization or carbonitriding) may render the corrective force insufficient or, conversely, an extremely high load becomes necessary to achieve the desired correction. To solve these problems, it becomes necessary to perform an additional step of grinding the annular element before hardening but then the production efficiency drops while the production cost increases.

In the two conventional approaches described above, the correction is performed before the martensite transformation and during it. The transformed portion of the workpiece is significantly improved in strength to develop elasticity and requires considerable force to be corrected. Stated more specifically, the portion of the workpiece that has become martensite as a result of the transformation has experienced the elastic deformation by the forced correction whereas the retained austenite undergoes plastic deformation due to transformation that occurs in the direction of corrective stress. This produces a structure involving much strain due to the mixture of elastic and plastic deformations.

Even if a workpiece which has already been formed in an elliptic form is placed on a round mold to perform correction during the martensite transformation, the workpiece cannot be completely corrected but it merely approaches a round shape and, depending on the ellipticity, some of the annular elements before hardening fail to be corrected in a satisfactory amount. Thus, the correction during the martensite transformation is encountered by difficulty in attaining roundness of high precision.

Rolling bearings of a type that is to be ground after heat treatments suffer from a dual problem in that not only the working efficiency is reduced by the deformation due to the heat treatments but it also varies (disperses) due to the change in the amount of grinding allowance. Stated more specifically, even if the amount of deformation that occurs in an annular element is reduced by performing the correction of deformations making use of the shrinkage that occurs before the martensite transformation and the expansion that occurs thereafter, however, the allowance for the grinding step which is performed subsequent to hardening cannot be significantly reduced if the absolute dimensions of the corrected annular element are variable. For example, in the case where bearings of the same designations are ground in large quantities, even if the amount of deformation is reduced, any dispersions in the absolute dimensions of the corrected annular elements make it impossible to achieve a significant reduction in the grinding allowance.

The dispersions in the absolute dimensions of the annular elements depend in most cases on the precision of lathe turning in the preceding step. In order to achieve dimensional uniformity, grinding may also be performed in the preceding step as already mentioned or, alternatively, cold roll forming is performed as proposed in Unexamined Japanese Patent Publication No. Hei. 6-83872. As already mentioned, the first case is disadvantageous in terms of production efficiency and cost. In the second case which performs strong cold working such as cold roll forming, so much strain is retained in the raw material that dimensional changes or extensive deformation may potentially occur in the subsequent steps of heat treatments.

SUMMARY OF THE INVENTION

The present invention has been accomplished under conventional circumstances and has as an object providing a method and an apparatus in which the deformation that develops in an annular element during the heating stage of hardening on account of preliminary working or heat treatments such as carburization is corrected by plastic working of the element as it is pressed, while being austenitic, into a slightly smaller mold such as to yield round products having neither strains nor deformations but having uniform dimensions.

This object of the present invention can be attained by a method of correcting the hardening deformation of an annular steel element, characterized in that during the cooling stage of hardening, the annular element while it still has an austenitic structure is subjected to working on either the outside or inside diameter, with the degree of working being 0.05–1.0% if it is on the outside diameter and 0.5–3.0% if it is on the inside diameter.

According to another aspect, the object of the present invention can be attained by a method of correcting the hardening deformation of an annular steel element, characterized in that just before the cooling stage of hardening, the annular element is subjected to working on its outside with the degree of working being 0.05–1.0%, and then subjected to the cooling stage of hardening.

In addition, the object can be attained by an apparatus for correcting the hardening deformation of an annular element, the apparatus including a hardening bath filled with a hardening medium, an annular element heated to an austenitic region and having an austenitic structure, a mold having an insider diameter which is smaller than an outside diameter of the annular element by 0.05–1.0% of a degree of working the annular element, and a forcing device forcing the annular element into the mold to harden the annular element in the hardening bath at a temperature not higher than the Ms point at the same time or after forcing the annular element.

BRIEF DESCRIPTION OF THE DRAWINGS

FIG. 5A is a graph when the correction is performed under the constant temperature of correction and FIG. 5B is a graph when it is performed while the temperature of correction varies;

DETAILED DESCRIPTION OF THE INVENTION

The present invention is generally related to so-called "press quenching" in which a workpiece under hardening is subjected to corrective working as it is constrained forcibly by a mold or the like. The present inventors performed extensive experimentation on various aspects of this technique including the method of constraining the workpiece, the right time to constrain it and the method of pressure application. As a result, the inventors have found the following.

1. If deformation is corrected after the start of the martensite transformation, particularly by using only the transition of the workpiece (annular element) from thermal shrinkage to expansion due to the martensite transformation, then strain is retained in the corrected workpiece and when it is liberated upon subsequent spontaneous cooling or during other subsequent steps such as cleaning, tempering and finishing, deformation occurs again.

2. During hardening, the amount by which the annular element expands or shrinks varies with the steel species such as carbon content and hardening conditions such as temperature and medium (whether it is water or oil). On the other hand, the absolute dimensions of the corrected annular element depend on the dimensions before the correction. In short, the dimensional dispersions that exist in an annular element before correction are retained in the corrected element and it may have changed in terms of absolute dimensions but not in terms of relative dispersions.

Based on these findings, the present inventors conducted intensive studies in order to develop a method by which the hardening deformation of annular elements could be corrected without suffering from the problems of the conventional art. As a result, an entirely novel method of correcting the deformation of annular elements has been completed and is hereby presented as the present invention.

Hereinafter the principles of the present invention as a method of correcting the hardening deformation of annular elements, the criticality of various numerical limitations and other characterizing features of the present invention are discussed in detail.

In the method of the present invention for correcting the hardening deformation of an annular steel element, the workpiece (annular element) is pressed into a mold of slightly different dimensions while the structure of steel is still austenitic and the deformation is corrected by plastic working such as to yield a round product having neither strains nor deformations. As typically known for hot forging, steels in the austenite state have lower properties in hardness and tensile strength but their elongation and drawing sufficiently increase to facilitate plastic working.

Figure 2A:
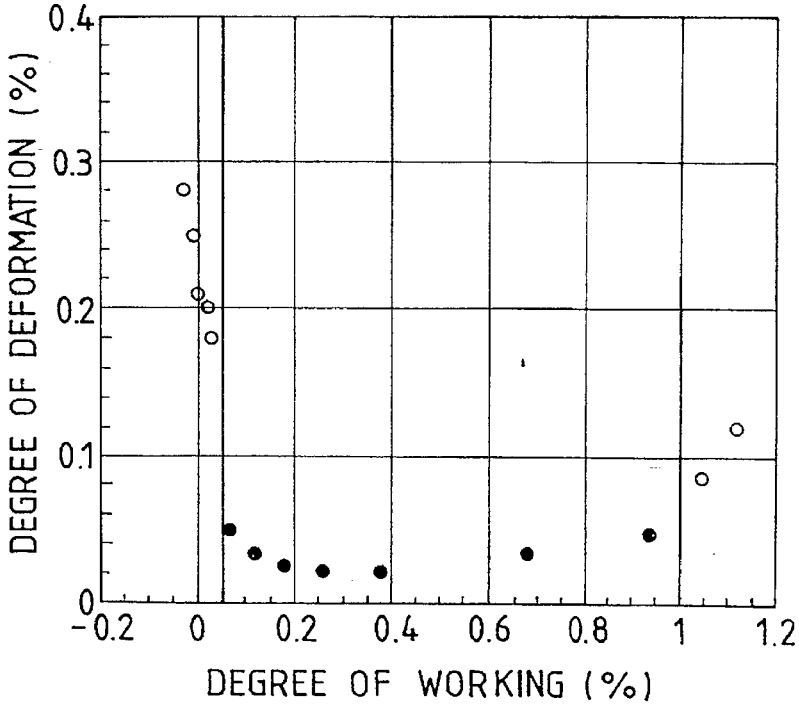
FIG. 2A is a graph showing the relationship between the degree of working on annular elements by the hardening deformation correcting method of the present invention and the degree of deformation that remained after the correction, particularly relating to the case of working on the outside diameter of the annular element (o.d. constrained)
Figure 2B:
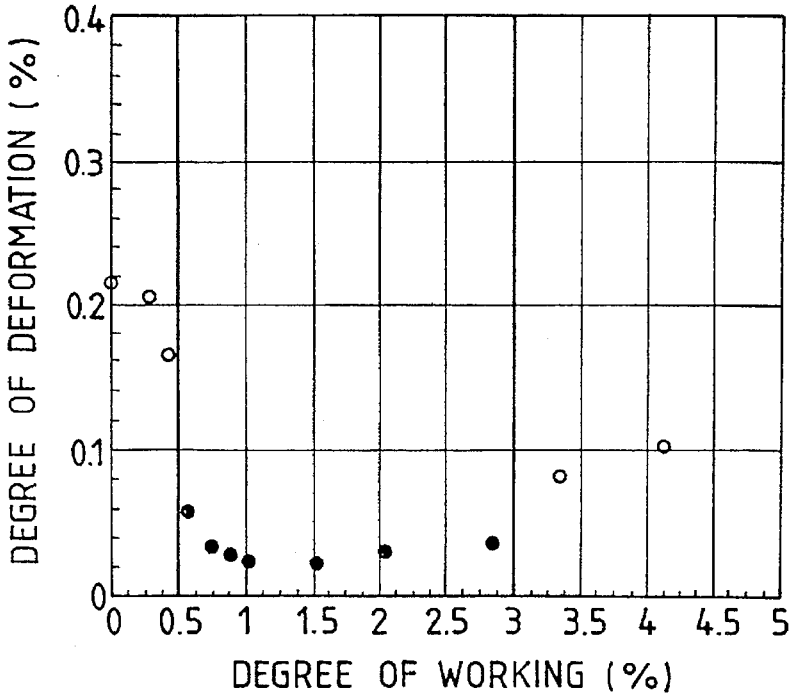
FIG. 2B is a graph showing the same relationship as FIG. 2A, except that it relates to the case of working on the inside diameter of the annular element (i.d. constrained)

The performance in correcting deformations by plastic working is varied with the degree of the working. FIGS. 2A and 2B each shows the relationship between the degree of working on annular elements by the method of the present invention while they were in the austenite state and the degree of deformation that remained after the correction. FIG. 2A refers to the results of working on the outside diameter of the annular element (o.d. constrained) and FIG. 2B refers to the results of working on the inside diameter of the annular element (i.d. constrained).

First, the method of measuring the degree of working is described. In the o.d. constrained case, the degree of working is expressed by:

Degree of working with o.d. constrained $$=[(D-i)/D]\times 100(\%) \quad (1)$$

where D is the outside diameter of the annular element and i is the inside diameter of the mold in which the annular element is to be set.

In the i.d. constrained case, the degree of working is expressed by:

Degree of working with i.d. constrained $$=[(I-d)/d]\times 100(\%) \quad (2)$$

where d is the inside diameter of the annular element and I is the outside diameter of the mold which is to be set in the annular member.

The respective dimensions of the annular element and the mold shall be measured at ordinary temperatures (20°–30° C.) for determination of the degree of working. The actual dimensions of the annular element under correction by plastic working increase as a result of thermal expansion and the degree of working on the annular element while the steel is austenitic is higher than the value calculated by Eq. (1) in the o.d. constrained case but lower then the value calculated by Eq. (2) in the i.d. constrained case. Accordingly, in the o.d. constrained case, the corrected degree of working is expressed by:

Corrected degree of working with o.d. constrained $$=W_0+(T-300)/500(\%) \quad (3a)$$

where $W_0$ is a value calculated through Eq. (1) using the outside diameter of the annular element as measured at ordinary temperatures (20°–30° C.) and T is the temperature of correction (° C.).

In the i.d. constrained case, the corrected degree of working is expressed by:

Corrected degree of working with i.d. constrained $$=W_i-(T-300)/500(\%) \quad (3b)$$

where $W_i$ is a value calculated through Eq. (2) using the outside diameter of the annular element as measured at ordinary temperatures (20°–30° C.) and T is the temperature of correction (° C.).

Next, there is described the method of measuring the degree of deformation. With the outside diameter D of the annular element being taken as a reference, Dmax (a maximum value of D) and Dmin (a minimum value of D) are measured and the difference Dmax–Dmin is taken as the roundness of the annular element. The roundness (mm) is divided by Dmin and expressed in percent. The average taken from measurements on 60 samples of the annular element which has been subjected to hardening and tempering is defined as the degree of deformation and expressed by:

Degree of deformation $$=[(Dmax-Dmin)]/Dmin\times 100(\%) \quad (4)$$

As is apparent from FIGS. 2A and 2B, the degree of deformation is stable if the degree of working is within the range from 0.05% to 1.0% for the o.d. constrained case and from 0.5% to 3.0% for the i.d. constrained case.

On the other hand, if the degree of working is less than 0.05% (for the o.d. constrained case) or less than 0.5% (for the i.d. constrained case), the degree of deformation is so high that the desired corrective effect of plastic working cannot be developed. Hence, according to the present invention, the lower limit for the degree of working is set to 0.05% for the i.d. constrained case and to 0.5% for the i.d. constrained case.

The degree of working cannot be increased indefinitely because increasing the degree of working results in that a kind of energy is applied to the workpiece which is to be worked, so that the strain-induced martensite transformation is promoted to develop rigidity in the workpiece; as a result, the ability of plastic working to correct the deformation decreases progressively to introduce instability in the degree of deformation. In addition, a higher pressure need be applied and depending on the size or wall thickness of the annular element, it becomes difficult to perform the desired corrective operation with conventional press quenching equipment. Hence, according to the present invention, the upper limit for the degree of working is set to 1.0% for the o.d. constrained case and 3.0% for the i.d. constrained case.

Furthermore, in the o.d. constrained case, higher degrees of working may roughen the corrected surface and undesirably affect the working in subsequent steps; hence, the degree of working is preferably limited to 0.7% or less in the o.d. constrained case.

In principle, the method of the present invention for correcting the hardening deformation of an annular element requires the correction by plastic working to be completed before the martensite transformation begins.

On the other hand, according to the conventional methods, if the deformation is corrected by using only the transition of the workpiece from thermal shrinkage to expansion due to the martensite transformation, then strain is retained in the corrected workpiece and when it is liberated in the process of subsequent spontaneous cooling or during cleaning, tempering and any other subsequent steps such as finishing, deformation occurs again.

This is because the corrective process yields a structure mixing a part that has remarkably been improved in strength and has experienced elastic deformation due to the transformation without making plastic deformation possible by using only superplastic phenomena (trip phenomena) that occur during the martensite transformation, and other parts that have undergone plastic deformation. The mixed structure causes internal strain to be retained in the corrected workpiece.

If the hardening deformation of the workpiece is corrected according to the present invention while its structure is still austenitic before undergoing the martensite transformation, the desired roundness can be created within a short time to insure that the hardened structure is substantially free from internal strain. As a result, the occurrence of deformation due to the reason of internal strain is negligible.

Once the corrective working is completed in the method of the present invention for correcting the hardening deformation of an annular element, the workpiece need no longer be corrected but is preferably cooled uniformly during the martensite transformation. As already mentioned, the present invention starts to correct the deformation of the workpiece while it is still austenitic before undergoing the martensite transformation but the correction is not necessarily completed before the martensite transformation occurs. In most practical cases (particularly when the workpiece is a small annular element), the correction is completed in three seconds after it was started and this does not mean that the correction must be completed before the martensite transformation but that the correction in principle is performed in the austenite region. Desirably, the correction is completed before the martensite transformation occurs.

Therefore, in the method of the invention for correcting the quench deformation of an annular element, the corrective working need not necessarily be completed before the martensite transformation begins and once the annular element is corrected by working in the austenitic state, no significant corrective working is performed even if the martensite transformation begins thereafter. Instead, fine correction can be performed by making use of a superplastic phenomena (commonly known as "trip phenomena") that occurs during the martensite transformation and this contributes to the production of an annular element that involves only a small amount of residual strain and which has an undeformed round shape. This approach may be adopted as an option.

When annular elements are hardened in large quantities in a continuous furnace, the method in common use is "free fall hardening", in which the workpieces being carried on a belt through a heating furnace are dropped randomly into an oil bath. A problem with this approach is that depending on the dropping condition of annular elements as well as their quantity and shape, uneven cooling is likely to occur and the deformation tends to become large. According to an alternative approach called a "position control" method in which the workpieces to be hardened are contained in baskets to maintain their position constant throughout the hardening process, uneven hardening is unlikely to occur. On the other hand, this alternative method cannot effectively prevent the deformations that occur for other reasons than uneven cooling, such as those which develop due to the residual strain before hardening, or which develop due to the transformation that progresses in post-hardening steps such as cooling, cleaning and tempering. In almost all cases of press quenching which is the conventional method of corrective hardening, the "position control" method is adopted. However, both the "free fall" and "position control" methods have heretofore utilized the martensite transformation to correct deformations but have not effected working in the austenite region.

The corrective hardening apparatus to be used in implementing the method of the present invention for correcting the hardening deformation of annular elements has special features which are incorporated in the cooling method and jigs in order to ensure that the use of corrective jigs would not lower the cooling capacity. Stated specifically, a jig for constraining the bore (inside diameter) of an annular element includes holes through which a jet of coolant can pass to be blown against the workpiece for cooling it (see FIG. 7C). Before its outside diameter is constrained, the annular element is cooled with a jet of coolant that is applied from the outside and, immediately thereafter, correction is made by an o.d. constraining jig (see FIG. 7D); thereafter, the jig is removed and the annular element is subjected to another cooling with a jet of coolant (see FIG. 7E). By adopting this procedure, the occurrences of uneven cooling and deformations due to other phenomena can be reduced at the same time.

Figure 3:
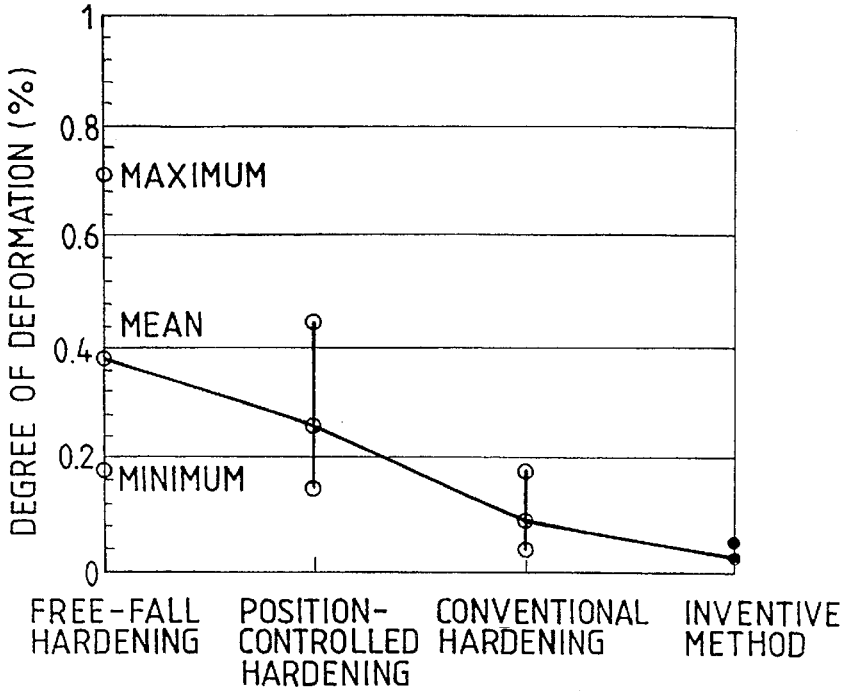
FIG. 3 is a graph showing the data on the mean, maximum and minimum values for the degree of deformation that occurred in the performance of various conventional hardening methods as compared with the data obtained by practicing the method of the present invention.

Table 1 in below shows the average degree of deformation that occurred after the completion of each subsequent step of hardening, cleaning and tempering in the performance of a conventional correcting method as compared with the data obtained by practicing the method of the present invention. Table 2 in below and FIG. 3 show the data on the mean, maximum and minimum values for the degree of deformation that occurred in the performance of three conventional correcting methods as compared with the method of the present invention.

TABLE 1

| Method | Degree of deformation immediately after hardening, % | after cleaning, % | after tempering, % |
|---|---|---|---|
| Conventional method | 0.065 | 0.069 | 0.090 |
| Invention method | 0.021 | 0.022 | 0.023 |

TABLE 2

| Method | Minimum deformation, % | Maximum deformation, % | Mean deformation, % | Degree of working, % |
|---|---|---|---|---|
| Free fall | 0.180 | 0.710 | 0.380 | — |
| Position control | 0.150 | 0.450 | 0.260 | — |
| Conventional method | 0.040 | 0.180 | 0.090 | — |
| Invention method | 0.018 | 0.053 | 0.023 | 0.26 |

Thus, according to the method of the present invention, not only uniform cooling could be accomplished but also the thermal deformation as well as the deformations that would develop during cleaning and tempering steps could be reduced to minimum levels and, as a result, the levels of deformation that could be assured were even lower than those attained by the conventional correcting method and this enabled annular elements to be hardened with reduced deformations and, hence, with improved dimensional stability.

The method of the present invention for correcting the hardening deformation of annular members is particularly beneficial if it is applied to rolling bearings which is subjected to grinding after heat treatments because the time of grinding can be considerably saved.

Grinding after heat treatments is essential to rolling bearings but the grinding cost is substantial. In order to save this high cost, rolling bearings of certain sizes or types are subjected to the correction of deformations so that the grinding allowance is reduced. If the correction is made by utilizing the martensite transformation as in the conventional method, the amount of deformation can be reduced but the absolute dimensions of the annular members of rolling bearings cannot be identical for all of the corrected parts.

Figure 4:
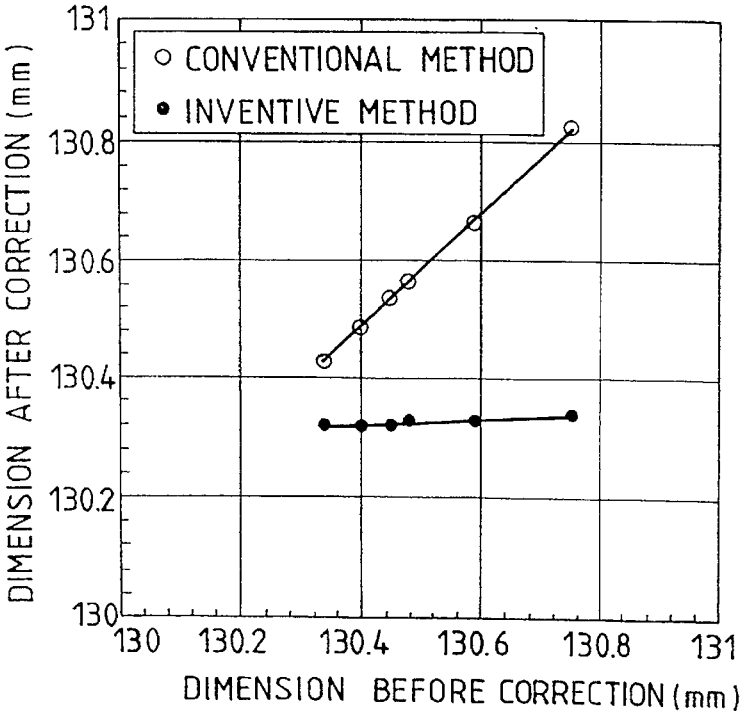
FIG. 4 is a graph showing the data on the dimensional changes that occurred in the annular elements of rolling bearings when they were corrected by the conventional method and the method of the present invention.

FIG. 4 shows exemplary data on the dimensional changes that occurred in the annular elements of rolling bearings when they were corrected by the conventional deformation correcting method. After the martensite transformation starts, the correction is applied by utilizing the expansion due to the martensite transformation. Thus, plastic deformation occurs to such an extent that the deformation existing in workpieces could be corrected but does not occur enough to change the absolute dimensions of the workpieces. Therefore, the dimensional differences (dispersions) that existed before the correction are carried into the post-corrective stage. A probable reason for the smallness of the plastic deformation that occurred in the practice of the conventional method of correction is that with only the martensite transformation being utilized, the workpiece has an increased elastic limit and, given the same amount of strain, it would not readily deform plastically but experiences elastic recovery. Thus, the raceways of rolling bearings can be corrected for any deformation such as off-roundness from round surfaces but the dispersions in their dimensions such as inside and outside diameters that occur due to the low precisions of preceding steps such as lathe turning and forging remain as such even after the correction is performed. In short, any dispersions that existed in the above-noted dimensions prior to correction are carried into the post-corrective stage. This is why the correction can reduce the existing deformation to improve the roundness of the annular element of a rolling bearing but cannot realize a substantial cut on the grinding allowance.

In contrast, the method of the present invention for correcting the hardening deformation of annular elements preforms correction while the annular elements are in the less elastic austenite state and, hence, only a small force is required to realize complete plastic deformation which can change the absolute dimensions of the annular elements. FIG. 4 shows exemplary data on the dimensional changes that occurred in the outside diameters of rolling bearings when they were corrected by the method of the present invention, as contrasted with the data obtained by the conventional method. Obviously, the outside diameters had some variance (dispersions) before correction but they were substantially identical after the correction.

Thus, according to the method of the present invention, the amount of deformation (or degree of deformation) could be made smaller than when the conventional deformation correcting method (press quenching) was applied and, at the same time, the dispersions in the degree of deformation that remained after the correction could also be reduced. What is more, the precision in lathe turning and the dimensional dispersions that existed between successive charges to the lathe could effectively be corrected to provide the same outside diameter for all of the workpieces, thereby achieving a substantial cut on their grinding allowance.

In order to eliminate the dispersions in the absolute dimensions of annular elements, lathe turning may be followed by a grinding step but, as already mentioned, this presents economic disadvantages including the addition of the grinding cost and the reduction in the efficiency of continuous production. Cold roll forming (hereunder abbreviated as "CRF") has recently been proposed as a low-cost alternative to lathe turning that can be adopted to work annular elements. CRF is either followed by fine lathe turning as a finishing step or performed up to the stage where the final shape is attained. In the former case, lathe turning is effected as a finishing step, so the dispersions that occur to the absolute dimensions of the workpiece are not much different than in the conventional method. In the latter case, the absolute dimensions of the worked annular element and the precision of its wall thickness are much better than can be achieved by lathe turning and, what is more, the working cost is reduced. However, CRF which is a cold working process causes greater strain to be retained in the annular element than when it is worked by lathe turning. This results in the occurrence of an even greater deformation if the workpiece is hardened without correction. In addition, depending on the degree of working that is applied by CRF, the annular element may potentially expand abnormally during subsequent heat treatments.

Accordingly, even if in the lathe turning cost by CRF could be reduction, in contrast, the great deformation that occurs in subsequent heat treatments causes the total cost to increase rather than decrease.

If the annular element worked by CRF is corrected for deformation by the method of the present invention, a satisfactory roundness can be attained. Particularly in the case of an annular element that has been worked by CRF up to the stage where the final shape is attained, the inherent high precision required to its wall thickness contributes also to an improvement in the roundness of the inside diameter which has not been subjected to the direct correction. As a result, the grinding allowance can be remarkably reduced.

Table 3 in below shows the degrees of deformation on the inside and outside diameters of annular elements that were hardened after they were worked by either conventional lathe turning or CRF which was applied up to the stage where the final shape was attained. The samples that were first worked by CRF and then hardened by the "free fall" or "position-controlled" had higher degrees of deformation on both inside and outside diameters than the samples that were hardened after conventional lathe turning. Even when they were corrected by the conventional correction method, the CRF samples largely deformed in heating to such an extent that they could not be corrected satisfactorily. Therefore, the degree of deformation was high to the outside diameter. In contrast, when the method of the present invention was applied, even the CRF samples could effectively be corrected while the degree of deformation to the outside diameter was as low as in the lathe-turned samples. The degree of deformation to the inside diameter of lathe-turned samples was slightly high compared to the degree of deformation to the outside diameter. This is because as a result of the correction working on the outside diameter, all dimensional problems that were caused by lathe turning such as the unevenness wall thickness and dimensional errors had to be absorbed by the inside diameter. On the other hand, the CRF samples had such a high precision in wall thickness that the correction working on their outside diameter resulted in the production of a complete round that was satisfactory in terms of not only outside diameter but also inside diameter.

Conditions for Experiment on CRF Annular Elements

| | | |
|---|---|---|
| Samples | Material | SUJ2 |
| | Annular element | Outer race of spherical roller bearing 222214 (nominal o.d., 125 mm; nominal width, 31 mm) |
| CRF conditions | Working machine | CRF140 presented by Kyoei Seiko Ltd. |
| | Flare ratio in CRF | 1.4–1.7 |
| Heat treatment conditions | Heat treatment | held at 850° C. for 30 minutes |
| | Temperature of quench oil | 80° C. |
| | Tempering conditions | 170° C. × 2 hours |

TABLE 3

| Method of correction | Annular elements worked by conventional lathe turning: Degree of deformation, % o.d. | i.d. | Degree of working % | Annular elements worked by CRF: Degree of deformation, % o.d. | i.d. | Degree of working, % |
|---|---|---|---|---|---|---|
| Free fall hardening | 0.384 | 0.391 | — | 0.435 | 0.442 | — |
| Position-controlled | 0.259 | 0.257 | — | 0.389 | 0.379 | — |
| Conventional method | 0.106 | 0.132 | — | 0.130 | 0.138 | — |
| Invention method | 0.025 | 0.051 | 0.26 | 0.024 | 0.025 | 0.26 |

The method of the present invention for correcting the hardening deformation of annular elements has the additional advantage of producing the desired annular elements in much higher efficiency than has been attainable by the conventional techniques.

Deformation correcting and hardening methods have generally the disadvantage of increased heat treatment costs. They require special equipment for correcting deformations and a different mold jig is necessary for each size of annular elements. In addition, the correction of hardening deformation continues from the start to the completion of a hardening process, so annular elements have to be treated individually rather than continuously and the efficiency of their production is very low. However, if the annular elements are to be subjected to grinding and other finishing steps after heat treatments as in the case of the raceway rings of rolling bearings, then the correction of deformations may occasionally lower the total cost because the grinding allowance is reduced.

Figure 5A:
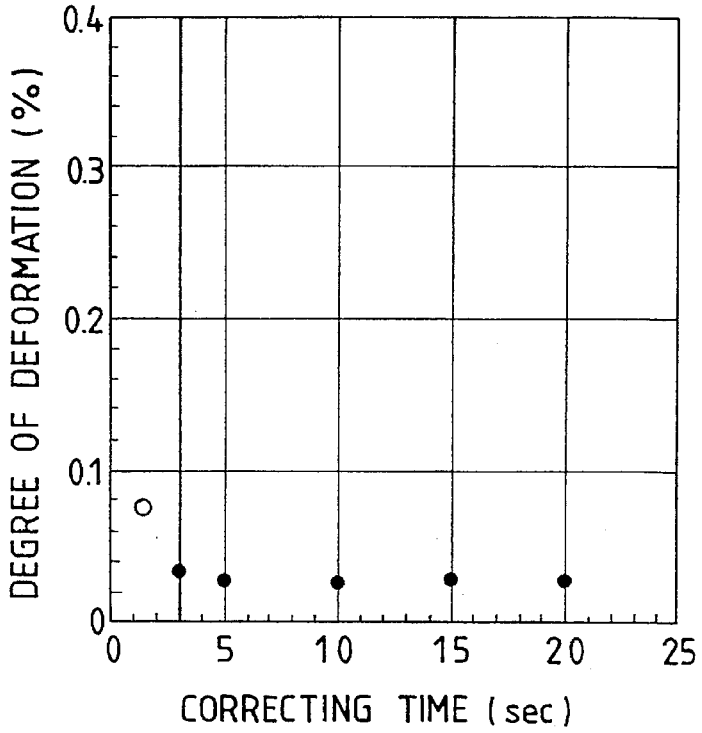
FIGS. 5A and 5B are graphs showing the relationship between the time required to perform correction by the method of the present invention and the degree of deformation that remained after the correction; in particular.
Figure 5B:
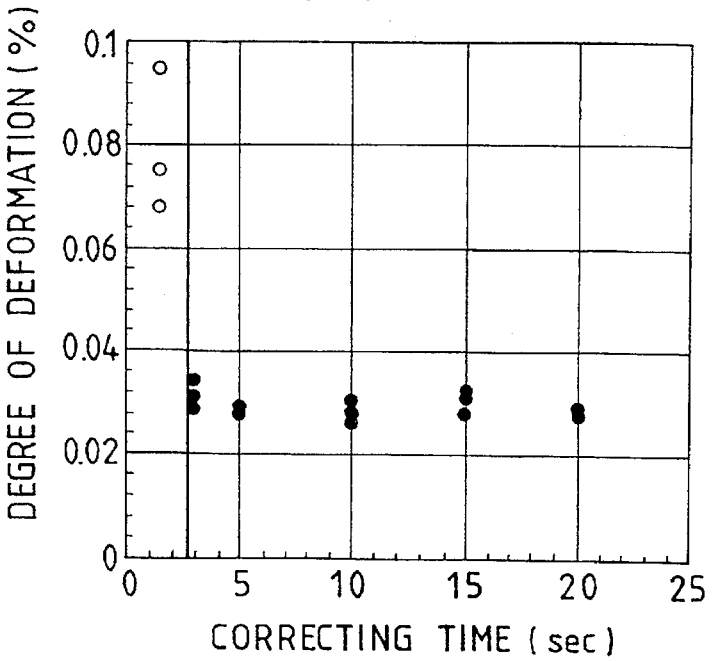

According to the method of the present invention, the hardening deformation of annular steel elements is corrected by plastic working while the steel is still in the austenite state. Once the working is completed, it is no longer necessary to continue the correcting operation; therefore, the time required to accomplish the intended correction is very short. FIG. 5A shows the relationship between the time required to perform correction by the method of the present invention and the degree of deformation that remained after the correction. Obviously, when the correcting time was less than three seconds, the corrective effect was insufficient to prevent the increase in the degree of deformation; on the other hand, the degree of deformation did not change even when the correction was performed longer than three seconds. Therefore, a minimum time of treatment that Was necessary to achieve complete correction is only three seconds. As shown in FIG. 5B, this fact is the same result as even if the temperature of correction varies.

Figure 6A:
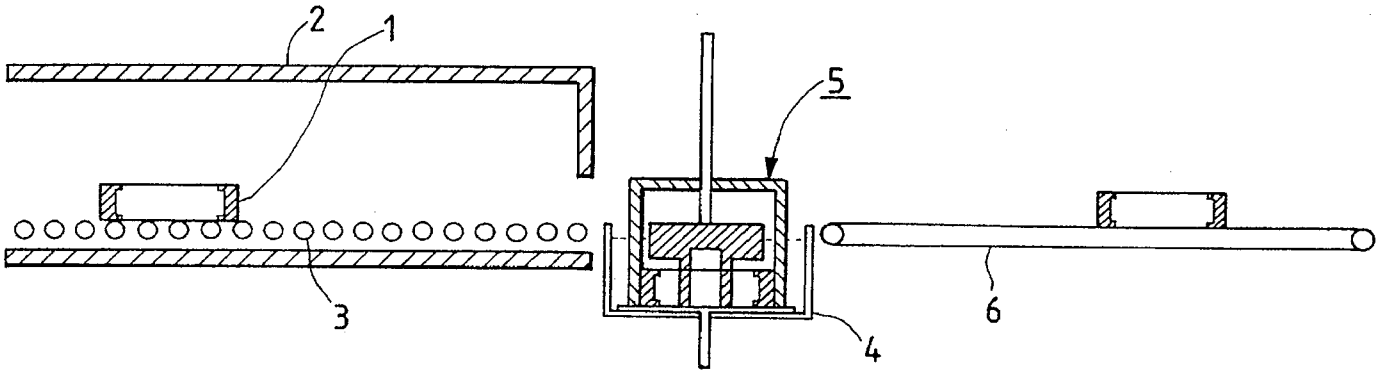
FIG. 6A PRIOR ART
FIG. 6A is a diagram showing conceptually the corrective cycle of a conventional method of correcting the hardening deformation of annular elements.
Figure 6B:
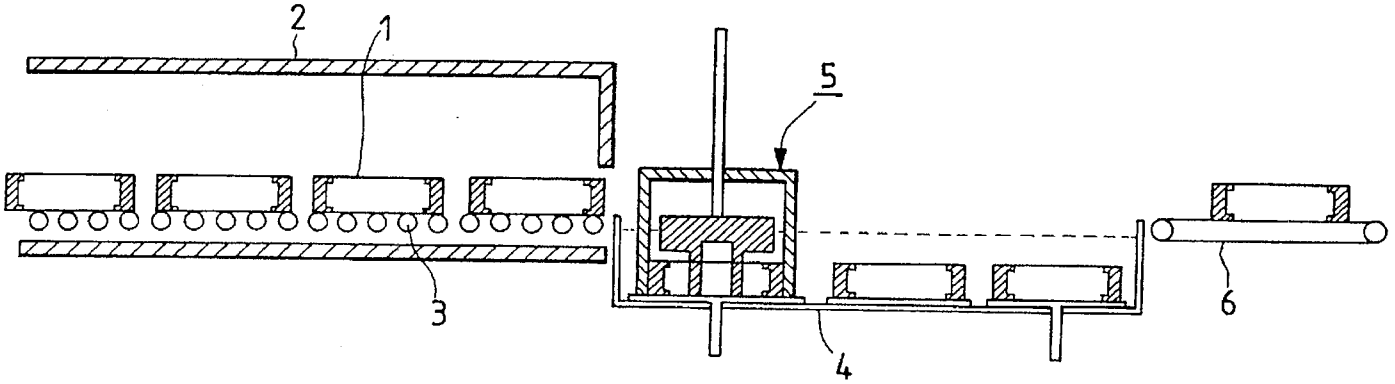
FIG. 6B is a diagram showing conceptually the corrective cycle of the method of the present invention.

FIGS. 6A and 6B each shows conceptually the correcting cycle of a conventional method of correcting the hardening deformation of annular elements as compared with the method according to the present invention. The conventional method shown in FIG. 6A requires such a long time to complete the intended correction that annular elements 1 cannot be treated continuously. Annular elements 1 are heated in a heating furnace 2 as they are carried individually on a roll conveyor 3 and thereafter hardened in a cooling bath 3 at the exit end of the furnace. The elements are corrected for deformation by a correcting device 5 throughout the period of hardening. Therefore, the correcting cycle from the start of hardening to the pickup by a belt conveyor 6 is long enough to reduce the overall production efficiency. In contrast, the method of the present invention illustrated in FIG. 7B requires only a very short time to complete the desired correcting cycle and enables continuous treatment. Annular elements 1 are heated in the heating furnace 2 as they are carried on the roll conveyor 3 at very short intervals and are thereafter charged into the hardening and cooling bath 4. Immediately after the start of cooling, the deformation in each annular element is corrected for about three seconds by the correcting device 5 while the steel structure is still austenitic; thereafter, the correction is released and the workpiece is kept cooled as it is moved through a cooling bath 4. Then, the next annular element 1 is corrected for deformation. As the hardening operation is completed, the annular elements 1 are successively recovered from the cooling bath 4 and picked up by a belt conveyor 6. In this way, the method of the present invention can produce the desired annular elements in an extremely higher efficiency than the conventional method for correcting the hardening deformation of annular elements.

Next, embodiments of the present invention will now be described with reference to accompanying drawings.

The annular elements treated in a first embodiment correspond to outer races of cylindrical roller bearings and spherical roller bearings.

First, the apparatus used in the first embodiment to implement the method of the present invention for correcting the hardening deformation of the annular elements is described with reference to FIGS. 7A to 7E.

The apparatus 5 includes a hardening bath 17 mounted on a platform 18, a pressure cylinder 10 provided above the hardening bath 17 and fixed to a frame (not shown), an o.d. constraining jig 14 mounted movable on a piston rod 13 of the pressure cylinder 10, and a flat surface holding jig 15 fixed to the bottom end of the piston rod 13. The inside diameter of the o.d. constraining jig 14 is finished to such a size that it is slightly smaller than the pretreatment outside diameter of an annular element 1 before correction and that it is able to correct the deformation by forcing the annular element 1 into the o.d. constraining jig 14 (by constraining the outside diameter of the annular element).

The hardening bath 17 has a detachable seat 24 in the center of its top for carrying the annular element 1. In the first embodiment under consideration, a quench oil 19 is used as a coolant. The seat 24 has a coolant blow hole (not shown) formed in the center. The hole communicates with a downwardly extending quench oil pipe 20. The quench oil pipe 20 is connected to a quench oil feeder (not shown), from which the quench oil is supplied into the quench oil pipe in a controlled manner such that the quench oil 19 is released through the hole in the seat 24 only when it is necessary.

A cylinder unit 21 for vertical movement of the quench oil pipe 20 is located below this pipe. The quench oil pipe 20 is connected to a piston rod 22 and can be moved up and down together with the seat 24 of the annular element.

The hardening bath 17 has a plurality of spouts 30 through which the quench oil 19 from the feeder (not shown) is supplied into the bath.

The pressure cylinder 10 includes a main cylinder 11 and a sub-cylinder 12 located below the main cylinder. The piston rod 13 of the pressure cylinder 10 is common to both the main cylinder 11 and the sub-cylinder 12 which is adapted for vertical movement in such a manner that it can be moved independently of the piston rod 13 or unitedly with the latter whichever the case is required.

The shapes of the o.d. constraining jig 14 and the flat surface holding jig 15 may be determined according to the geometry of the annular element 1.

Being thus constructed, the apparatus 5 operates in the following manner. First, the annular element 1 (the outer race of a cylindrical roller bearing in the first embodiment under consideration) emerging hot from the heating furnace is placed on the seat 24 (see FIG. 7A). In this mode, the cylinder unit 21 is in an operational state and the seat 24 is located in the highest position, namely, on the top of the hardening bath 17, which is above the level of the quench oil 19.

In the next step, the main cylinder 11 is operated to lower the piston rod 13 and the flat surface holding jig 15 is urged against the seat 24 carrying the annular element 1 so that the seat is pressed downward. As the piston rod 13 in lowered, the sub-cylinder 12 and the o.d. constraining jig 14 descend simultaneously (see FIG. 7B).

Figures 7A, 7B, 7C, 7D, 7E:
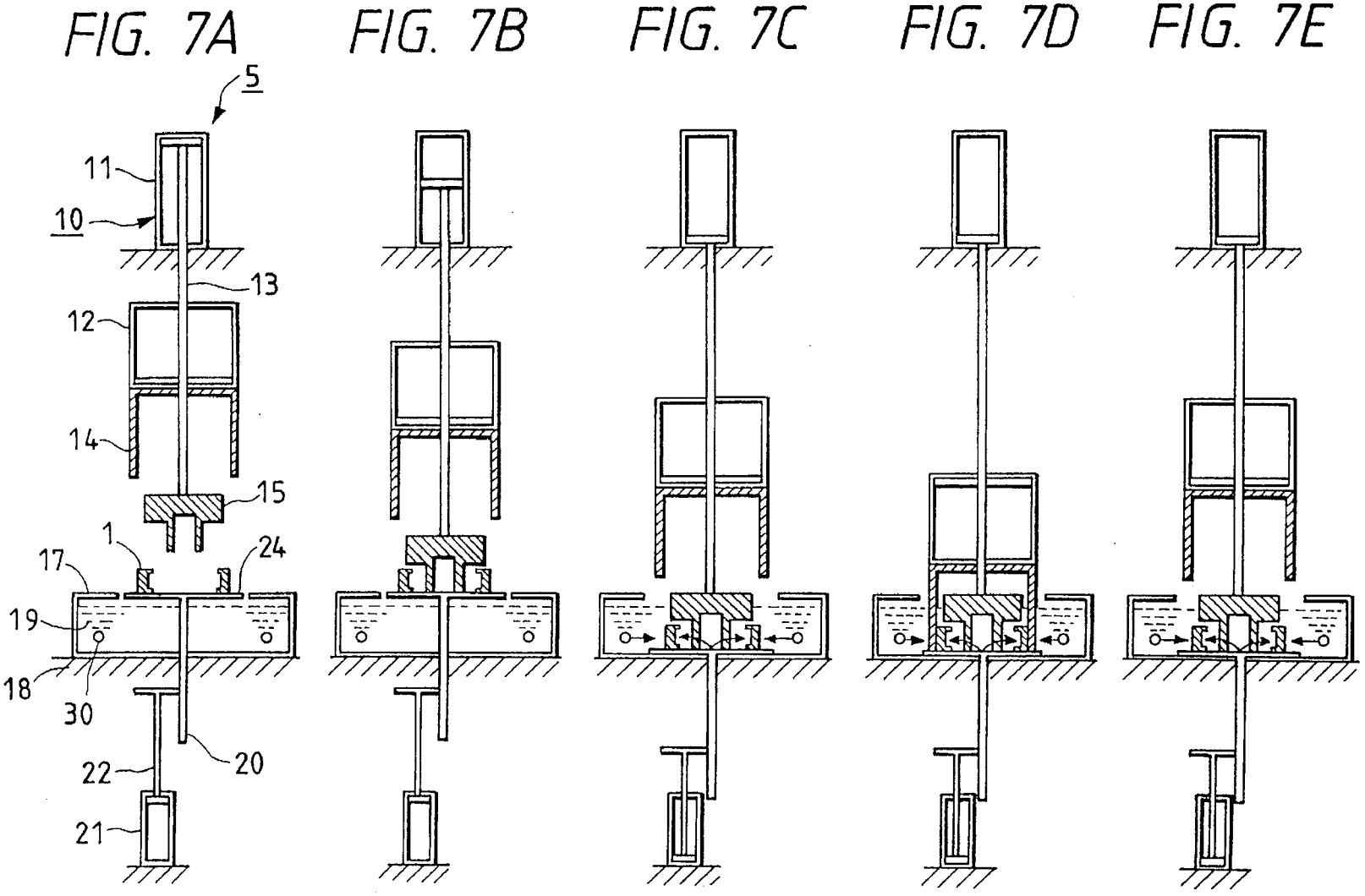
FIGS. 7A to 7E each shows in section the sequence of steps in the operation of an apparatus for correcting the hardening deformation of annular elements according to a first embodiment of the present invention.

In the subsequent stage shown in FIG. 7C, the cylinder unit 21 keeps operational in the ascending direction but due to the stronger force of the main cylinder 11 which is directed downward, the seat 24 is kept held down by the jig 15 and continues to descend together with the piston rod 22 and the quench oil pipe 20. When the seat 24 has arrived at the bottom of the hardening bath 17, it stops so that the annular element 1 carried on the seat 24 is immersed in the quench oil 19 in the bath 17. At the same time, a jet of the quench oil is supplied through the pipe 20 and the spouts 30. such that it is blown against both the inner and outer circumferential surfaces of the annular element 1 for forced-cooling it rapidly.

Subsequently, the sub-cylinder 12 is operated to lower the o.d. constraining jig 14 until it is set in contact with the outer circumferential surface of the annular element 1 so as to start the step of constraining the outside diameter of the annular element 1 (see FIG. 7D). The steps shown in FIGS. 7A to 7D require about 10 seconds to perform and the step shown in FIG. 7D of constraining the outside diameter of the annular element 1 is performed within a short period of 3–5 seconds while the annular element is in the austenite state, whereby the process of correcting the deformation in the element is completed.

Thereafter, the sub-cylinder 12 is operated in reverse direction so that the jig 14 is lifted to release the annular element from the o.d. constraining action of the jig (see FIG. 7E). Subsequently, the main cylinder 11 is operated in reverse direction to raise the piston rod 13 together with the sub-cylinder 12 and the jig 14, whereupon one cycle of corrective procedure is completed.

Until the hardening is completed, the annular element 1 is immersed in the quench oil 19 in the bath 17 but it need not be cooled at the same site; instead, it may be moved sideways through the quench oil for cooling purposes and, in this way, a space is provided for starting the next cycle of correcting the deformation in another annular element 1.

If the flat surface holding jig 15 in the apparatus 5 is replaced by an i.d. constraining jig, the hardening deformation of the annular element can be corrected by constraining its inside diameter.

EXAMPLES

There is now described the experiment conducted to correct the hardening deformation of annular elements using the apparatus 5.

The specifications of the annular elements used in the experiment, their constituent material and the conditions of the heat treatment performed were as set forth below.

| | |
|---|---|
| Material | SUJ2 |
| Heat treatment | 850° C. × 30 minutes |
| Temperature of quench oil | 80° C. |
| Tempering conditions | 170° C. × 2 hours |
| Annular element | outer race of cylindrical roller bearing NU312 |

(Ring TP: nominal o.d., 130 mm; nominal width, 31 mm)

Tables 4, 5 and 6 show the data on the degree of deformation that occurred when the outside diameter of the annular elements was constrained with the degree of working, the correcting time and correction starting temperature being set at varying values.

TABLE 4

| Run No. | Temperature of correction °C. | Degree of working, % | Correcting time, sec. | Degree of deformation % |
|---|---|---|---|---|
| Invention | | | | |
| 1 | 300 | 0.07 | 10 | 0.050 |
| 2 | 300 | 0.12 | 10 | 0.034 |
| 3 | 300 | 0.18 | 10 | 0.026 |
| 4 | 300 | 0.26 | 10 | 0.023 |
| 5 | 300 | 0.38 | 10 | 0.023 |
| 6 | 300 | 0.66 | 10 | 0.035 |
| 7 | 300 | 0.94 | 10 | 0.048 |
| Comparison | | | | |
| 8 | 300 | −0.03 | 10 | 0.280 |
| 9 | 300 | −0.01 | 10 | 0.250 |
| 10 | 300 | 0.00 | 10 | 0.210 |
| 11 | 300 | 0.02 | 10 | 0.200 |
| 12 | 300 | 0.03 | 10 | 0.180 |
| 13 | 300 | 1.05 | 10 | 0.086 |
| 14 | 300 | 1.12 | 10 | 0.120 |
| 15 | 300 | 0.18 | 1.5 | 0.075 |
| Invention | | | | |
| 16 | 300 | 0.16 | 3 | 0.034 |
| 17 | 300 | 0.18 | 5 | 0.028 |
| 18 | 300 | 0.18 | 10 | 0.026 |
| 19 | 300 | 0.18 | 15 | 0.028 |
| 20 | 300 | 0.18 | 20 | 0.027 |

Table 4 shows the data on experiments for correction that were conducted during the cooling stage of hardening at 300° C. where the temperature of correction was relatively stable. Run Nos. 8 and 9 as comparative samples had negative values for the degree of working and the corrective effect on them is negligible unless substantial deformation occurs during the correction working. The samples on which the degree of working was less than 0.05% received a certain amount of corrective working but the degree of deformation in the corrected annular elements was high, indicating the absence of the corrective effect. When the degree of working exceeded 1.0% as in Run Nos. 13 and 14 the application of strong working resulted in an increasing degree of deformation.

At least three seconds was necessary to achieve the intended correction. At longer times, the degree of deformation did not vary significantly. However, when the correcting time was less than 3 seconds as in Run No. 15, the degree of deformation increased, indicating deterioration in the corrective effect.

Tables 5 and 6 show the data on experiments for correction that were conducted in an early stage and, hence, at higher temperatures. As in the experiment where correction was performed at 300° C. the degree of deformation increased when the degree of working was less than 0.05% or greater than 1.0%. Similarly, the degree of deformation was high when the time of correction was shorter than 3 seconds.

The "temperature of correction" means the temperature at which correction is started and this definition is similarly applied to the following description. The temperature of correction is controlled on the basis of the preliminarily determined relationship between the cooling time and the temperature of the annular elements to be hardened.

Figure 2C:
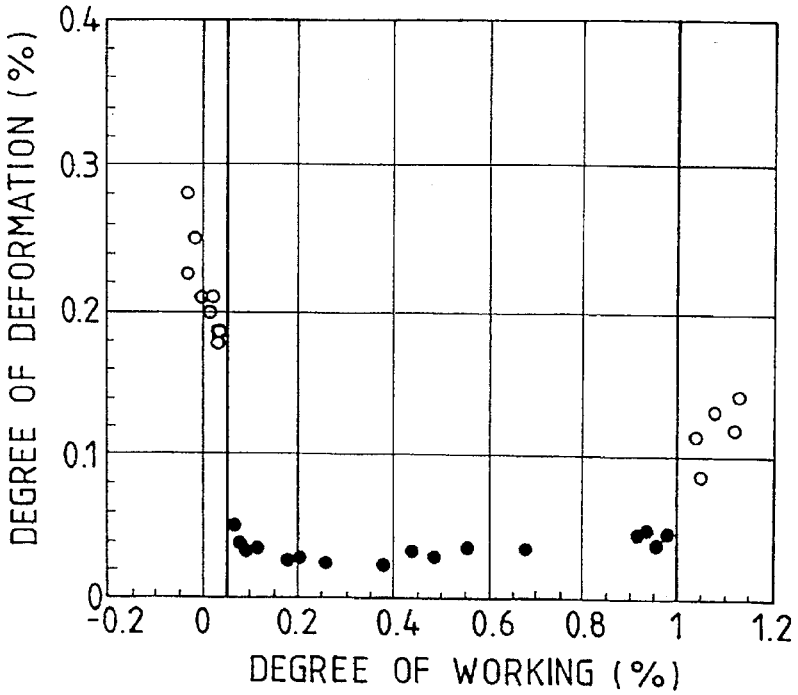
FIG. 2C is a graph showing the same relationship as FIG. 2A in o.d. constrained case, except that the correction is performed while the correcting temperature varies.

The data shown in FIG. 2A (Table 4) and those shown in Tables 5 and 6 are combined and shown in FIG. 2C, from which one can see that the tendency observed at 300° C. remained substantially the same even when the temperature of correction was increased to higher values.

TABLE 5

| Run No. | Temperature of correction °C. | Degree of working, % | Correcting time, sec. | Degree of deformation % |
|---|---|---|---|---|
| Invention | | | | |
| 1B | 450 | 0.08 | 10 | 0.038 |
| 2B | 450 | 0.20 | 10 | 0.028 |
| 3B | 450 | 0.56 | 10 | 0.034 |
| 4B | 450 | 0.98 | 10 | 0.046 |
| 5B | 630 | 0.09 | 10 | 0.035 |
| 6B | 630 | 0.21 | 10 | 0.026 |
| 7B | 630 | 0.44 | 10 | 0.032 |
| 8B | 630 | 0.92 | 10 | 0.045 |
| 9B | 830 | 0.09 | 10 | 0.031 |
| 10B | 830 | 0.21 | 10 | 0.028 |
| 11B | 830 | 0.49 | 10 | 0.029 |
| 12B | 830 | 0.96 | 10 | 0.038 |
| Comparison | | | | |
| 13B | 450 | 0.02 | 10 | 0.210 |
| 14B | 450 | 1.08 | 10 | 0.132 |
| 15B | 630 | −0.03 | 10 | 0.226 |
| 16B | 630 | 1.04 | 10 | 0.115 |
| 17B | 830 | 0.03 | 10 | 0.186 |
| 18B | 830 | 1.13 | 10 | 0.144 |

TABLE 6

| Run No. | Temperature of correction °C. | Degree of working, % | Correcting time, sec. | Degree of deformation % |
|---|---|---|---|---|
| Invention | | | | |
| 1C | 450 | 0.20 | 3 | 0.031 |
| 2C | 450 | 0.20 | 5 | 0.029 |
| 3C | 450 | 0.20 | 10 | 0.028 |
| 4C | 450 | 0.20 | 15 | 0.031 |
| 5C | 450 | 0.20 | 20 | 0.027 |
| 6C | 630 | 0.21 | 3 | 0.030 |
| 7C | 630 | 0.21 | 5 | 0.029 |
| 8C | 630 | 0.21 | 10 | 0.026 |
| 9C | 630 | 0.21 | 15 | 0.028 |
| 10C | 630 | 0.21 | 20 | 0.027 |
| 11C | 830 | 0.21 | 3 | 0.029 |
| 12C | 830 | 0.21 | 5 | 0.028 |
| 13C | 830 | 0.21 | 10 | 0.030 |
| 14C | 830 | 0.21 | 15 | 0.032 |

TABLE 6-continued

| Run No. | Temperature of correction °C. | Degree of working, % | Correcting time, sec. | Degree of deformation % |
|---|---|---|---|---|
| 15C | 830 | 0.21 | 20 | 0.029 |
| Comparison | | | | |
| 16C | 450 | 0.20 | 1.5 | 0.068 |
| 17C | 630 | 0.21 | 1.5 | 0.075 |
| 18C | 830 | 0.21 | 1.5 | 0.095 |

Table 7 shows the dimensional changes that occurred in annular element that were corrected for hardening deformation with their outside diameter being constrained by the method of the present invention, as compared with the data obtained by the conventional method.

TABLE 7

| Size before correction, mm | Conventional method, mm | Inventive method, mm | Degree of working, % |
|---|---|---|---|
| 130.34 | 130.43 | 130.32 | 0.07 |
| 130.40 | 130.49 | 130.32 | 0.12 |
| 130.45 | 130.54 | 130.32 | 0.15 |
| 130.48 | 130.57 | 130.33 | 0.18 |
| 130.59 | 130.67 | 130.33 | 0.26 |
| 130.75 | 130.83 | 130.34 | 0.38 |

Mold size: 130.25 mm

The "mold size" means the inside diameter of the o.d. constraining jig 14 in the apparatus 5. The numerals except those in the column of "degree of working" represent the outside diameter of the sample annular elements.

The data in Table 7 shows that given the same amount of strain, the samples which were corrected by the conventional method using the martensite transformation did not easily deform plastically but instead experienced elastic recovery, whereby the dispersions in the outside diameter that developed in the preceding step were carried into the post-correction stage. On the other hand, the method of the present invention which corrected deformation while the samples were still in the austenite state caused completely plastic deformation and, hence, the dispersions in the outside diameter of the samples before correcting were effectively eliminated to provide substantially identical dimensions for the corrected samples.

Next, another experiments were conducted to correct the hardening deformation of annular elements by constraining their inside diameter.

Figure 8:
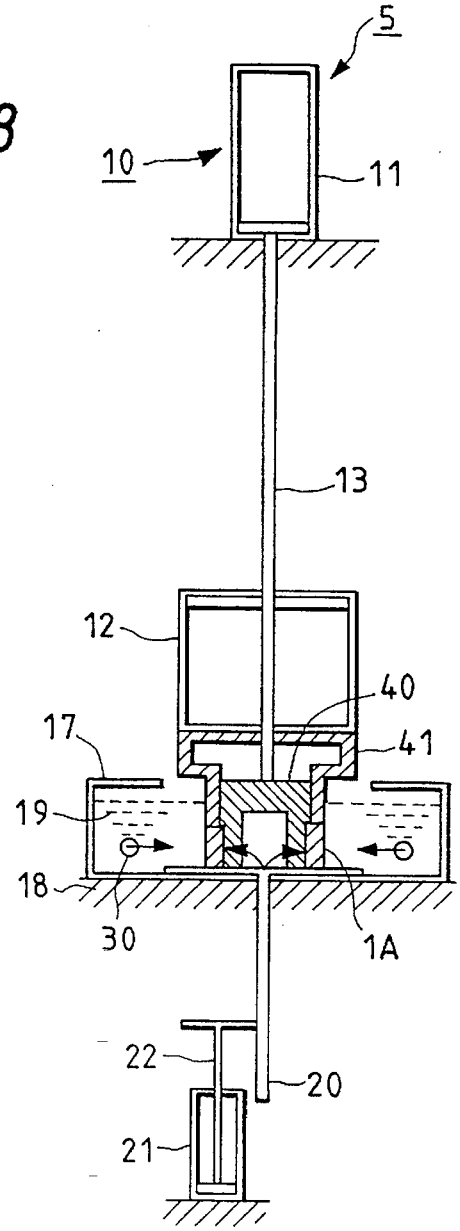
FIG. 8 is a partial enlarged view of an apparatus for correcting the hardening deformation of annular elements, with their inside diameter constrained, in the first embodiment of the present invention.

The apparatus 5 used in the experiments had an i.d. constraining jig 40 (i.d. mold) and a flat surface holder 41 as shown in FIG. 8. The sample annular elements 1A were cylindrical roller bearings.

The results of the experiment with respect to the degree of working, the correcting time and the degree of deformation are shown in Table 8 below for the case of the present invention and that of a comparative example.

TABLE 8

| Run No. | Degree of working, % | Correcting time, sec | Degree of deformation, % |
|---|---|---|---|
| Invention | | | |
| 21 | 0.56 | 10 | 0.060 |
| 22 | 0.75 | 10 | 0.035 |
| 23 | 0.89 | 10 | 0.030 |
| 24 | 1.02 | 10 | 0.026 |
| 15 | 1.53 | 10 | 0.023 |
| 26 | 2.05 | 10 | 0.032 |
| 27 | 2.85 | 10 | 0.038 |
| Comparison | | | |
| 28 | 0.00 | 10 | 0.215 |
| 29 | 0.28 | 10 | 0.206 |
| 30 | 0.42 | 10 | 0.165 |
| 31 | 3.35 | 10 | 0.083 |
| 32 | 4.12 | 10 | 0.103 |

The conditions of the heat treatment conducted in the experiments were identical to those employed in the experiments on o.d. constrained samples. The annular elements were the inner races of cylindrical roller bearing NU218 having a nominal inside diameter of 90 mm. The mold used as the i.d. constraining jig had a nominal outside diameter of 89.7 mm.

The data in Table 8 shows that Run Nos. 21–27 according to the present invention which were worked by 0.5–3.0% in the i.d. constrained case were very stable in the degree of deformation. On the other hand, in Run Nos. 28–32 of the comparative example which were worked by less than 0.5% or more than 3.0% with their inside diameter constrained, the degree of deformation was so high that the intended corrective effect of working could not be attained.

In third experiments, the steel species of the sample annular elements was changed to various types and they were corrected for hardening deformation by the inventive method with their outside diameter being constrained.

The specifications of the annular elements used in the experiment, their constituent materials and the conditions of the heat treatments performed were as set forth below.

| | |
|---|---|
| Materials | S17C, SCr420, SCr440 and SAE1060 |
| Heat treatments | Normal carburization (hardening) for 12 hours followed by standing to cool to an ordinary temperature, then heating at 850° C. for 30 minutes |
| Temperature of quench oil | 80° C. |
| Temper conditions | 170° C. × 2 hours |
| Annular element | outer race of cylindrical roller bearing NU312 |

Table 9 shows the data on the degree of deformation that occurred when the outside diameter of the annular elements was constrained, with the degree of working set at varying values for a constant correcting time.

TABLE 9

| Run No. | Steel species | Temperature of correction, % | Degree of working, % | Correcting time, sec. | Degree of deformation, % | Ms °C. |
|---|---|---|---|---|---|---|
| Invention | | | | | | |
| 33 | SCr420 | 450 | 0.10 | 10 | 0.053 | 430 |
| 34 | SCr420 | 450 | 0.21 | 10 | 0.030 | 430 |
| 35 | SCr420 | 450 | 0.35 | 10 | 0.035 | 430 |
| 36 | SCr420 | 450 | 0.68 | 10 | 0.048 | 430 |
| 37 | SCr440 | 450 | 0.09 | 10 | 0.052 | 355 |
| 38 | SCr440 | 450 | 0.22 | 10 | 0.042 | 355 |
| 39 | SCr440 | 450 | 0.38 | 10 | 0.031 | 355 |
| 40 | SCr440 | 450 | 0.69 | 10 | 0.033 | 355 |
| 41 | SAE1060 | 450 | 0.08 | 10 | 0.046 | 315 |
| 42 | SAE1060 | 450 | 0.25 | 10 | 0.034 | 315 |
| 43 | SAE1060 | 450 | 0.33 | 10 | 0.026 | 315 |
| 44 | SAE1060 | 450 | 0.66 | 10 | 0.031 | 315 |
| Comparison | | | | | | |
| 45 | S17C | 450 | 0.08 | 10 | 0.105 | 465 |
| 46 | S17C | 450 | 0.35 | 10 | 0.101 | 465 |
| 47 | S17C | 450 | 0.68 | 10 | 0.115 | 465 |
| Invention | | | | | | |
| 48 | S17C | 630 | 0.12 | 10 | 0.049 | 465 |
| 49 | S17C | 630 | 0.45 | 10 | 0.038 | 465 |
| 50 | S17C | 630 | 0.78 | 10 | 0.052 | 465 |

The effectiveness of correcting the hardening deformation of annular elements decreases considerably if martensite transformation begins before the correction is started. With steel species having low carbon content in the core, particularly, case hardening steels, the Ms temperature (at which the martensite transformation starts in the core) is high and, depending on the timing of the start of correction, the martensite transformation may already begin before the correction is started. In short, the case hardening steel of low carbon content (as in Run Nos. 45–47 of the comparative sample) has the possibility that if the Ms temperature in the core may be high with respect to the correction starting temperature, martensite transformation may have already started before correcting, thereby potentially deteriorating the effectiveness of the correcting step. Obviously, Run Nos. 45–47 of the comparative example which were formed of S17C were so high in the degree of deformation that they could not be effectively corrected for deformations.

In contrast, Run Nos. 33–44 within the scope of the present invention were formed of steel species having Ms temperatures not higher than 450° C. and characterized by remarkable results of the corrective effect.

Figure 12:
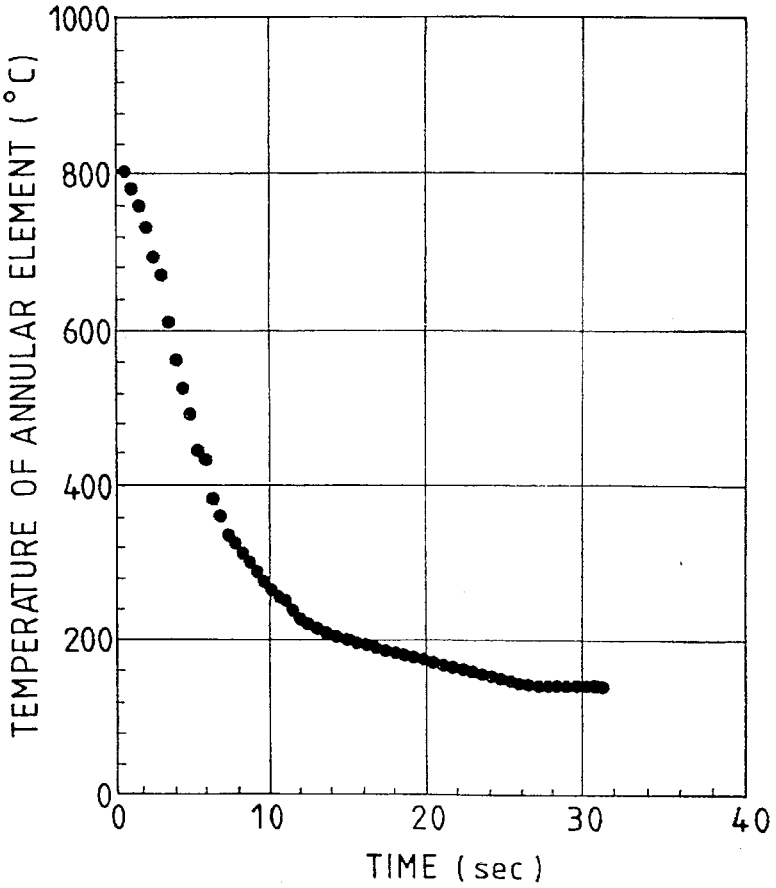
FIG. 12 is a graph showing exemplary data on the temperature profile in the process of the cooling stage of hardening the annular elements.

Run Nos. 48–50 were also within the scope of the present invention; obviously, by adopting an increased temperature of correction, steel species such as S17C having a high Ms temperature could be corrected satisfactorily. However, when correction is to be started at high temperature during the cooling stage of hardening, the workpiece (annular element) is in such a state that its temperature is changing abruptly as shown in FIG. 12 (to be discussed below). Hence, the degree of working is difficult to adjust and the stability in the corrective effect may potentially be deteriorated.

(The Ms temperature was calculated on the basis of the alloy elements using Eq. (2) set forth in "Tekko Zairyo (Iron and Steel Materials)", pp. 111–112, published by Corona Inc., April 1963.)

Figure 9:
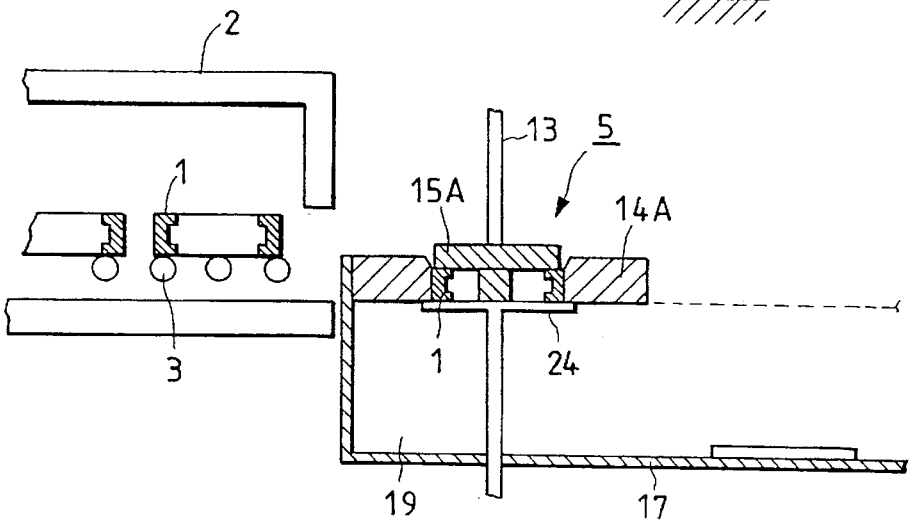
FIG. 9 is a partial enlarged view of an apparatus for correcting the hardening deformation of annular elements according to a second embodiment of the present invention.

FIG. 9 shows a second embodiment of the present invention. In the first embodiment described hereinabove, the annular elements as the workpieces are corrected for deformation as they are hardened in a quench oil (coolant). In the second embodiment to be described below, the annular elements are corrected for deformation just before hardening is subsequently done.

Stated more specifically, the annular element 1 just emerging from a heating furnace 2 is placed on a seat 24 located in the topmost part of a hardening bath 17. The annular element 1 keeps the placed position outside the bath 17 while it is held down by a jig 15A in the correcting apparatus. The deformation in the annular element is corrected by working with an o.d. constraining jig 14A. The working atmosphere is preferably an oxidation preventive atmosphere such as nitrogen gas or the like. The same procedure may be employed in the case of using an i.d. constraining jig instead of the o.d. constraining jig.

As already described, annular elements made of steel species having high Ms temperatures can successfully be treated with the apparatus shown in FIGS. 6 and 7 which performs correction during the cooling stage of hardening but it is slightly difficult to attain consistent results by this method. However, according to the second embodiment of the correcting method of the present invention, even annular elements made of materials having high Ms temperatures can easily be corrected for deformation.

Figure 10A:
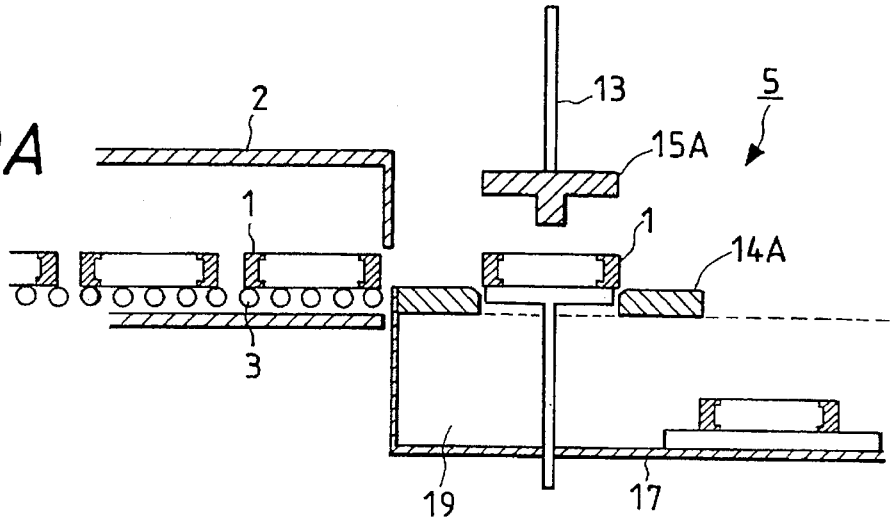
FIGS. 10A to 10C show in partial section the process scheme for correcting the hardening deformation of annular elements according to a third embodiment of the present invention.
Figure 10B:
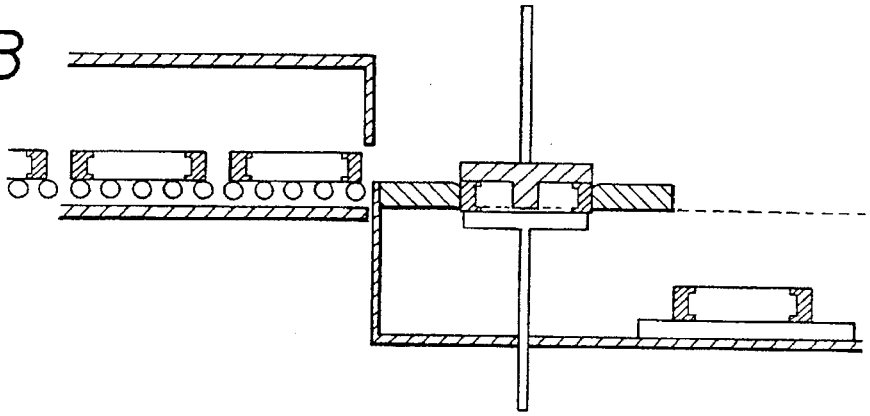
Figure 10C:
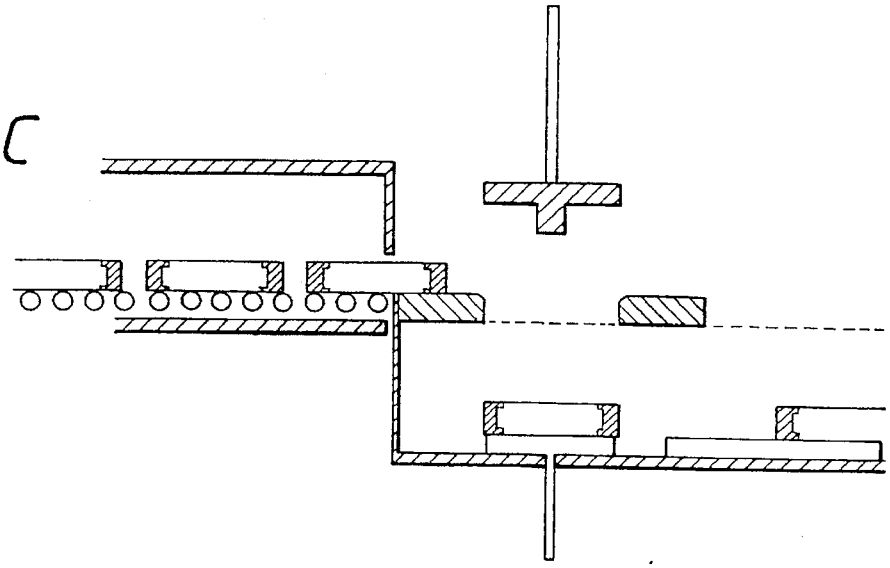

FIGS. 10A to 10C shows a third embodiment of the present invention in which the annular element is subjected to correction working just before the start of the cooling stage of hardening and thereafter is cooled in an oil bath. The third embodiment modifies the process scheme shown in FIG. 9 and can attains consistent results similarly to the second embodiment even if the correction is performed in the high-temperature range.

Stated more specifically, the annular element seat 24 (see FIGS. 10A to 10C) located in the topmost part of the hardening bath 17 has a slightly smaller diameter than the inside diameter of an o.d. corrective jig 14A. The seat 24 carries the annular element 1 just emerging from the heating furnace 2. In the carried condition (namely, outside the bath 17), the annular element 1 is held down under the load that is applied from above by a holding jig 15A in the correcting apparatus. The annular element 1 arranged thus is corrected by being forced into the bore of the jig 14A which has a slightly smaller inside diameter than the annular element to be corrected. The seat 24 serves as a guide, and therefore the apparatus 5 has a mechanism to press the annular element 1 straight into the mold 14A rather than obliquely, without any troubles such as galling would occur. The annular element 1 is corrected by working that occurred as it is passed through the correcting jig 14A so that the passing time through the jig is the time of correction. After the annular element 1 completely has passed the jig 14A, the jig 15A ascends to the initial position and the seat 24 carrying the annular element 1 descends moderately to the bottom of the hardening bath 17, where the annular element 1 moves slowly while it is cooled with the quench oil; the seat 24 then ascends to the initial position to receive the next annular element.

The experiments were conducted to verify the corrective effect of the process scheme shown in FIGS. 10A–10C by employing the following steel species and conditions of heat treatments.

| | |
|---|---|
| Materials | S17C, SCr420, SCr440, SAE1060 and SUJ2 |
| Heat treatments | Normal carburization (hardening) for 12 h, followed by standing to cool to ordinary temperature, then heating at 850° C. for 30 min, provided that SUJ2 was not carburized but simply heated at 850° C. for 30 min. |
| Temperature of quench oil | 80° C. |
| Tempering conditions | 170° C. for 2 hours |
| Annular element | Outer race of cylindrical roller bearing NU312 |

(Ring TP: nominal o.d., 130 mm; nominal width, 31 mm)

Figure 11:
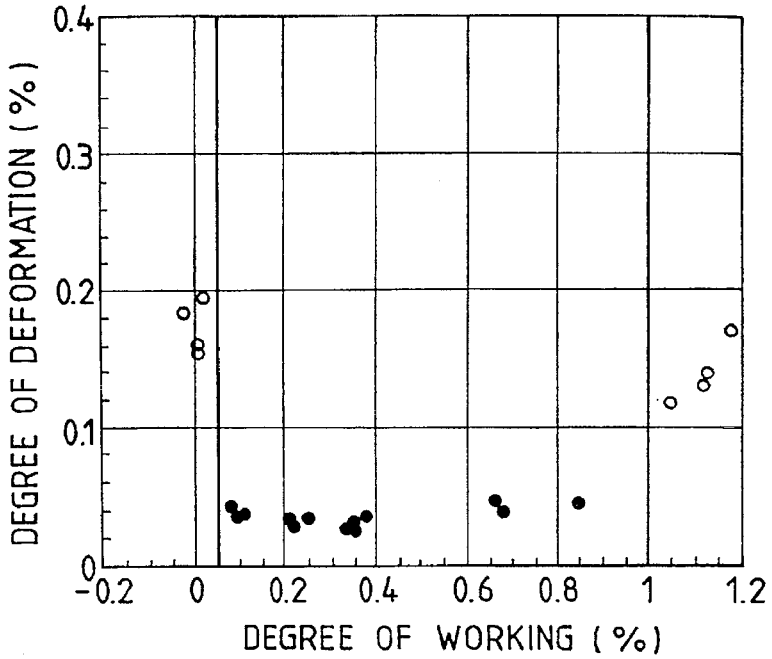
FIG. 11 is a graph showing the relationship between the degree of working on annular elements by the process scheme shown in FIGS. 10A to 10C which effected correction just before hardening and the degree of deformation that remained after the correction.

Table 10 and FIG. 11 show the data on the degree of deformation that occurred when the outside diameter of the annular elements was constrained, with the degree of working (as determined by Eqs. (1) to (3b)) being set at varying values for a constant time of correction (3–5 seconds).

Similarly to the first embodiment, the degree of deformation was consistently low when the degree of working was within the range from 0.05% to 1.0% and the results were independent of the steel species. On the other hand, the degree of deformation increased when the degree of working was less than 0.05% or in excess of 1.0%.

The time of correction was the time required for the annular element to pass the mold 14A and three seconds was sufficient for achieving the intended correction. Depending on the size of the bearing of interest, prolonged passage may cause an undue drop in the temperature of the annular element thereby resulting in insufficient hardening; hence, the annular element should typically be passed through the mold within about 5 seconds.

Accordingly, case hardening steels and other steel species having high Ms temperature in the core are corrected at temperatures higher than the Ms temperature. Hence, if correction is to be performed during the cooling stage of hardening as in the first embodiment, it is necessary to effect the correction in a fairly early stage. As Tables 5 and 6 show, the intended correction could be accomplished by adopting high temperatures. However, the temperature of the annular element changes sharply during correction at elevated temperatures. FIG. 12 shows exemplary data on the temperature profile in the process of the cooling stage of hardening the annular element. Obviously, the temperature of the annular element changed sharply as it was cooled down to about 300° C. On the other hand, according to the process scheme shown in FIGS. 10A–10C, the temperature of the annular element emerging from the heating furnace can be controlled by far more consistently until it is corrected with the mold 14A than when it is corrected within the quench oil (coolant). In short, when correction is to be made at high temperatures, particularly on steel species having high Ms temperatures, the process scheme shown in FIGS. 10A–10C may be adapted with advantage since annular elements that involve only a small amount of residual strain and that have an undeformed round cross section can consistently be produced with high efficiency.

Similar results can be attained by salt bath hardening using a molten salt as a coolant. According to this application, a salt bath is maintained at a temperature just at the Ms point of the annular element (or its core if it is formed of a case hardening steel) or at higher temperatures. The annular element held in the bath is first cooled from the hardening temperature, and then immediately subjected to correction of the hardening deformation by the apparatus shown in FIGS. 10A–10C (so-called "malquenching"). By the malquenching treatment, raw materials having high Ms temperature can be corrected by working before the martensite transformation begins, thus assuring the intended corrective effect to be exhibited in a consistent manner.

There is now described the correcting jig that can effectively be used to implement the method of the present invention.

In order to implement the method of the present invention successfully, it is necessary to employ a correcting jig in the form of a one-piece mold having a slightly smaller inside diameter than the size of the annular element which is about to be hardened.

Figure 1:
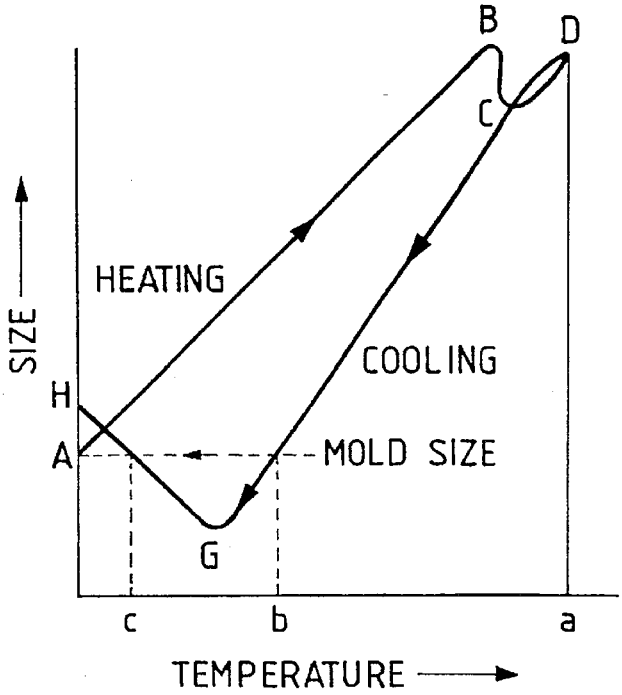
FIG. 1 is a graph showing the dimensional change that occurs during the heating and cooling of a carbon steel involving the martensite transformation.

In the conventional method which performs correction to the outside diameter of an annular element by utilizing only the expansion due to the martensite transformation, it is general to use molds of which the outside diameter is variable such as a split mold and a collet chuck. As shown in FIG. 1, the duration of time for which the dimensions of the annular element remain smaller than those of the mold is short. Depending on the amount of deformation that need be corrected, the duration of this time becomes even shorter. Under the circumstances, the operator using the variable mold first widens it and then sets it around the annular element as early as possible; before correcting the annular element, the operator adjusts the mold in compliance with the shrinkage of the annular element. At the time when it starts to expand, the correction begins. However, with these jigs, it is difficult to achieve the intended correction while the raw material is still in the austenite region. In addition, as pointed out in connection with the description of the conventional method, the method of correction that is performed after the martensite transformation begins to cause expansion of the raw material is capable of improving the degree of roundness to some extent but by no means capable of changing the absolute dimensions of the annular element. Hence, this method is unable to ensure that annular elements are correctively worked to uniform size.

Figure 13A:
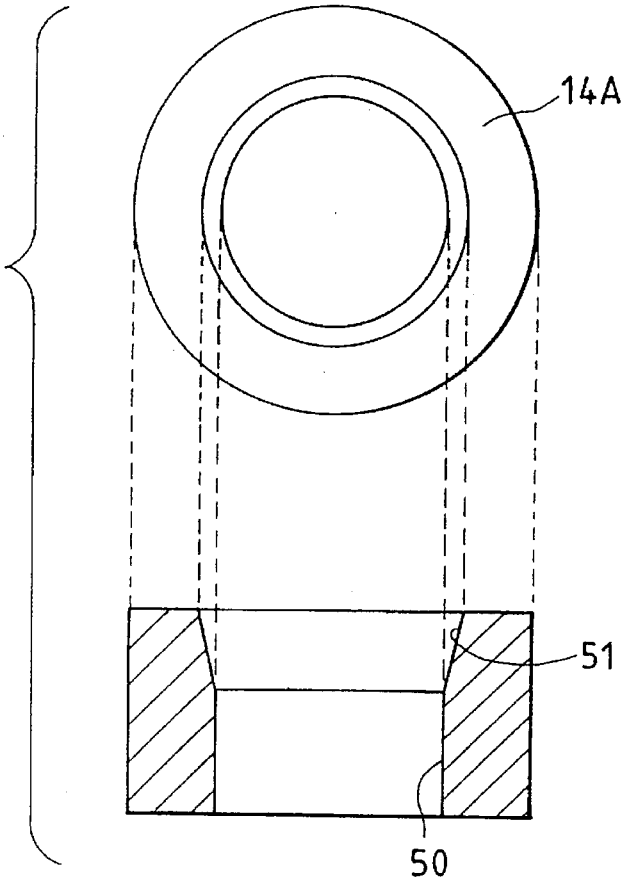
FIG. 13A shows a jig for use in correcting the hardening deformation of annular elements just before hardening according to the second embodiment.
Figure 13B:
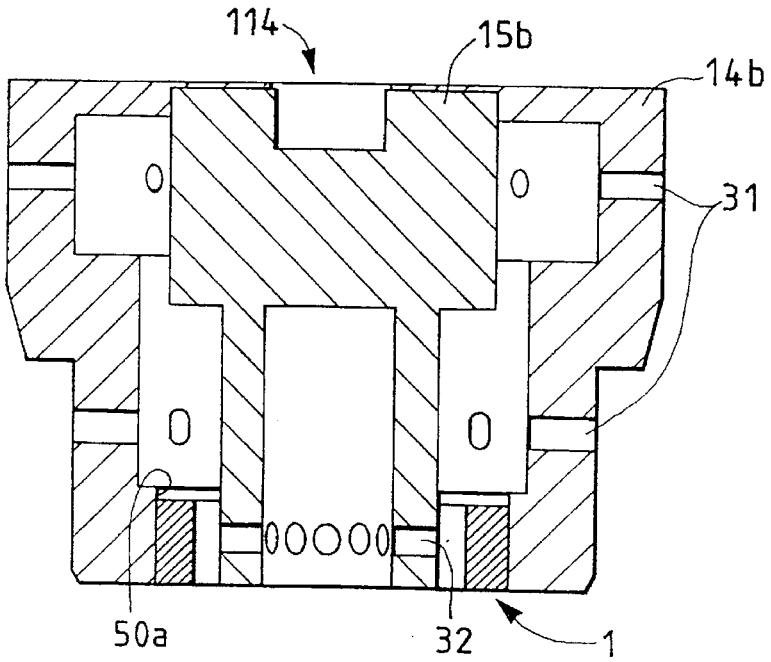
FIG. 13B shows a jig for use in correcting the hardening deformation of annular elements during the cooling stage of hardening according to the first embodiment.

FIGS. 13A and 13B show two examples of the jig that may be employed to implement the correcting method of the present invention. The mold 14A shown in FIG. 13A is intended for use when the workpiece is to be corrected just before hardening according to the second embodiment of the present invention. The mold 14A includes a correcting surface 50 and a tapered surface 51 for guiding the annular element. The jig 114 shown in FIG. 13B is for use when the workpiece is to be corrected during cooling according to the first embodiment. The jig 114 includes an o.d. constraining jig **14*b*, a flat surface holding jig 15*b*, coolant discharging ports 31, coolant spouts 32 and a correcting surface 50*a*. In both cases, the mold 14A and jig 114 are characterized by having a correcting part formed as an integral hollow cylindrical member. Only when the annular element is to be worked in the austenitic state, it can be forced smoothly into the mold in a short time if the degree of working is within the range specified by the present invention. This is why the method of the present invention can be implemented using compact molds that are thin-walled in the portion that performs correction working as shown in FIGS. 13A and 13B**. If working is effected after the martensite transformation has started, it is almost impossible to achieve the degree of working within the specified range. One can readily understand that in order to effect such post-working, it is necessary that the annular element to be heat-treated should not only be controlled precisely in dimension but also be forced into a sufficiently thick-walled mold in a large-scale apparatus under a huge load.

The conventional split mold has another problem. That is, depending on the conditions for correction, the profile of the mold is partly transferred onto the surface of the annular element being corrected and a mark appearing as petals of a flower is left, which has a great potential to seriously affect subsequent steps of working. The one-piece mold which is to be used in the present invention leaves no irregularities on the corrected annular member and, what is more, the latter has highly uniform dimensions to offer great benefits in subsequent steps of working.

The lightweight and compact jig has the obvious advantage of simplifying and scaling down the overall corrective equipment. In addition, the time of correction is reduced to as short as 3–5 seconds. Hence, the intended correcting and hardening can be accomplished in a very efficient continuous manner by implementing the method of the present invention using the above-described jig.

TABLE 10

| | Steel species | Degree of working, % | Degree of deformation, % |
|---|---|---|---|
| Invention | | | |
| 51 | SCr420 | 0.10 | 0.035 |
| 52 | SCr420 | 0.21 | 0.034 |
| 53 | SCr420 | 0.35 | 0.032 |
| 54 | SCr420 | 0.68 | 0.038 |
| 55 | SCr440 | 0.09 | 0.034 |
| 56 | SCr440 | 0.22 | 0.029 |
| 57 | SCr440 | 0.38 | 0.035 |
| 58 | S17C | 0.08 | 0.041 |
| 59 | S17C | 0.25 | 0.034 |
| 60 | S17C | 0.33 | 0.026 |
| 61 | S17C | 0.66 | 0.045 |
| 62 | SUJ2 | 0.11 | 0.036 |
| 63 | SUJ2 | 0.22 | 0.028 |
| 64 | SUJ2 | 0.35 | 0.026 |
| 65 | SUJ2 | 0.85 | 0.044 |
| Comparison | | | |
| 66 | SCr420 | 0.01 | 0.160 |
| 67 | SCr440 | −0.02 | 0.183 |
| 68 | S17C | 0.02 | 0.194 |
| 69 | SUJ2 | 0.01 | 0.156 |

TABLE 10-continued

| | Steel species | Degree of working, % | Degree of deformation, % |
|---|---|---|---|
| 70 | SCr420 | 1.12 | 0.128 |
| 71 | SCr440 | 1.05 | 0.116 |
| 72 | S17C | 1.13 | 0.138 |
| 73 | SUJ2 | 1.18 | 0.169 |

Thermomechanical processing is the combination of working and heat treatment on steels and known examples of this technique include work hardening such as working followed by hardening and "ausforming" which performs working in the hardening process ("Ko no netsushori" (Heat Treatments of Steels), P. 72, edited by the Iron and Steel Institute of Japan, published Oct. 1, 1969). However, these methods of thermomechanical processing are primarily intended for improving the mechanical properties (e.g. strength and toughness) of as-hardened steels and the degree of working they achieve range widely from about 30% to as high as about 95%. Hence, they differ greatly from the method of the present invention for correcting the hardening deformation of annular elements not only in terms of the objective but also from the viewpoint of the specific way of implementation.

As described above, the method of the present invention for correcting the hardening deformation of annular steel elements is such that an annular element, while the steel structure is still austenitic, is pressed into a mold and subjected to correction working by a specified degree; the desired working can readily be effected by plastic deformation under decreasing hardness and tensile strength but increasing degrees of elongation and drawing. As a result, the present invention offers the advantage of yielding completely round, strain-free or deformation-free annular elements within a short time.

What is claimed is:

1. A method of correcting a hardening deformation of an annular element made out of steel, comprising the step of:

working the annular element in at least one of outside and inside surfaces of the annular element for correcting the deformation, the working being started in a state that the annular element still has an austenitic structure during a cooling stage of hardening the annular element, wherein a degree of working is 0.05–1.0% if the outside surface is worked, and the degree of working is 0.5–3.0% if the inside surface is worked.

2. A method of correcting a hardening deformation of an annular element made out of steel, comprising the steps of:

working the annular element in at least one of outside and inside surfaces of the annular element for correcting the deformation, the working being started in a state that the annular element still has an austenitic structure, wherein a degree of working is 0.05–1.0% if the outside surface is worked, and the degree of working is 0.5–3.0% if the inside surface is worked; and subjecting the annular element to a cooling stage of hardening after the working step.

3. An apparatus for correcting a hardening deformation of annular elements, comprising:

a hardening bath filled with a hardening medium;

an annular element heated to an austenitic region and having an austenitic structure;

a mold having at least one dimension of an inside diameter which is smaller than an outside diameter of the annular element by 0.05–1.0% in a degree of working, and the outside diameter which is larger than the inside diameter of the annular element by 0.5–3.0% in the degree of working; and a working device forcing the annular element into the mold to work the annular element at a temperature which is higher than the Ms point.

4. The apparatus of claim 3, wherein the working device hardens the annular element in the hardening bath while the annular element is worked into the mold.

5. The apparatus of claim 3, wherein the working device hardens the annular element in the hardening bath after the annular element is worked into the mold.

* * * * *